US010605269B2

(12) United States Patent
Stadler et al.

(10) Patent No.: US 10,605,269 B2
(45) Date of Patent: Mar. 31, 2020

(54) FAN COMPRISING AN IMPELLER WITH BLADES

(71) Applicant: EBM-PAPST ST. GEORGEN GMBH & CO. KG, St. Georgen (DE)

(72) Inventors: Michael Stadler, Graz (AT); Peter Ragg, Schoenwald (DE); Wolfgang Laufer, Aichhalden (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 727 days.

(21) Appl. No.: 15/032,055

(22) PCT Filed: Feb. 12, 2015

(86) PCT No.: PCT/EP2015/052939

§ 371 (c)(1),
(2) Date: Apr. 25, 2016

(87) PCT Pub. No.: WO2015/124487

PCT Pub. Date: Aug. 27, 2015

(65) Prior Publication Data

US 2016/0265556 A1 Sep. 15, 2016

(30) Foreign Application Priority Data

Feb. 21, 2014 (DE) ..... 10 2014 102 311

(51) Int. Cl.
*F04D 29/66* (2006.01)
*F04D 29/16* (2006.01)
(Continued)

(52) U.S. Cl.
CPC ..... *F04D 29/666* (2013.01); *F04D 29/164* (2013.01); *F04D 29/327* (2013.01);
(Continued)

(58) Field of Classification Search
CPC .... F04D 29/164; F04D 29/327; F04D 29/328; F04D 29/384; F04D 29/663; F04D 29/666
See application file for complete search history.

(56) References Cited

U.S. PATENT DOCUMENTS 4,729,714 A * 3/1988 Wrobel ..... F04D 19/002 415/119
5,181,830 A * 1/1993 Chou ..... F04D 29/384 416/223 R
(Continued)

FOREIGN PATENT DOCUMENTS

AU 8151275 A 12/1976
DE 2545555 A 12/1975
(Continued)

*Primary Examiner* — Kenneth J Hansen
*Assistant Examiner* — Aye S Htay
(74) *Attorney, Agent, or Firm* — Dickinson Wright PLLC

(57) ABSTRACT

A fan has an impeller (20) that is equipped with blades (26, 28, 30, 32, 34; 58). The blades are configured so that the blade loading of individual blades differs during operation. As a result of this variable blade loading, the frequencies associated with the blade-passing noise (BPF) of the fan can be distributed over a broader frequency spectrum, and thus have a less obtrusive effect.

16 Claims, 15 Drawing Sheets

(51) Int. Cl.
*F04D 29/32* (2006.01)
*F04D 29/38* (2006.01)

(52) U.S. Cl.
CPC ..... *F04D 29/328* (2013.01); *F04D 29/384* (2013.01); *F04D 29/663* (2013.01); *F05D 2240/307* (2013.01)

(56) References Cited

U.S. PATENT DOCUMENTS

| | | | | |
|---|---|---|---|---|
| 7,438,522 | B2 * | 10/2008 | Eimer | F04D 29/164 415/173.6 |
| 7,438,714 | B2 | 10/2008 | Eimer | |
| 8,231,343 | B2 * | 7/2012 | Kayama | F04D 25/0613 415/220 |
| 8,915,717 | B2 | 12/2014 | Stephan et al. | |
| 8,974,199 | B2 | 3/2015 | Schmid et al. | |
| 2002/0182071 | A1 * | 12/2002 | Belady | F04D 29/384 415/220 |
| 2012/0177515 | A1 | 7/2012 | Schmid et al. | |
| 2012/0207606 | A1 * | 8/2012 | Stephan | F04D 29/384 416/204 R |

FOREIGN PATENT DOCUMENTS

| | | | |
|---|---|---|---|
| DE | 3614806 | A | 11/1986 |
| DE | 102011118656 | A | 5/2012 |
| EP | 2418389 | A2 | 2/2012 |
| EP | 2662573 | A1 | 5/2013 |
| FR | 2772830 | B1 | 6/1999 |
| JP | 2003184792 | A | 7/2003 |
| WO | 2004094835 | A | 11/2004 |

* cited by examiner $\phi 26 < \phi 28 < \phi 34 < \phi 30 < \phi 32$

FAN COMPRISING AN IMPELLER WITH BLADES

CROSS-REFERENCES

This application is a section 371 of PCT/EP2015/052939, filed Feb. 12, 2015 and further claims priority from DE 10 2014 102 311.0 filed Feb. 21, 2014.

FIELD OF THE INVENTION

The invention relates to a fan having an impeller equipped with blades. The blades are alternatively also referred to, inter alia, as "vanes," "fan vanes," or "rotor blades."

BACKGROUND

The Problem of Blade-Passing Noise

Let it be assumed that the impeller of a fan has a number z of blades that are arranged at identical distances ("equidistantly") in a circumferential direction, and that the impeller rotates at a rotation speed n (n being measured in revolutions/sec or $s^{-1}$).

What then results is a pressure fluctuation that is perceived by a stationary observer at a frequency $$BPF=z*n \quad (1)$$

This is referred to as "blade-passing noise" or a "blade-passing frequency" (BPF).

This blade-passing noise has an unfavorable effect on the acoustic quality of a fan because:

it represents an isolated energy-rich maximum in the acoustic power spectrum, and it is usually located in a frequency range to which human hearing is particularly sensitive.

The acoustic quality of fans plays an important role especially in workplaces or, for example, for a decentralized climate control system. Optimization thereof, and thus a reduction in the blade passing noise, is therefore very important.

Variable Angle Distribution

A well-established method for reducing blade-passing noise is variable angle distribution between the blades. The result is to distribute the blade-passing noise over several frequencies that differ slightly from one another. This can have psychoacoustic advantages because the radiated acoustic energy is no longer concentrated at a single frequency, and can therefore also be utilized in the context of the present invention.

SUMMARY OF THE INVENTION

An object of the invention is therefore to furnish a novel fan.

This object is achieved by a fan having an impeller that is equipped with a plurality of profiled blades and rotates during operation around a rotation axis, and having a fan housing surrounding the impeller on its outer side at a distance, the blades being implemented so that the blade loading of the individual blades differs during operation.

As a result of variable design of the blade loading of the individual blades of a fan, each blade is also exposed to different flow conditions. A number z of differently configured pressure fluctuations, which rotate synchronously at the rotation frequency n, is thereby obtained.

In contrast to a conventionally constructed impeller, this means the following:

A number z of pressure fluctuations having different amplitudes is obtained.

The individual pressure fluctuations rotate at the frequency n.

This brings about a reduction in the frequency of the blade-passing noise by a factor of 1/z. The blade-passing noise is thereby advantageously shifted, usually into a frequency range in which human hearing is less sensitive. This aspect is also taken into consideration in practice by way of the "A-weighting" of acoustic power level, e.g. "80 dB(A)."

For efficient reduction of blade-passing noise, it has proven advantageous to distribute the loading on the blades approximately sinusoidally in a circumferential direction.

Variable blade loading allows the frequencies associated with the blade-passing noise to be distributed over a broader spectrum than with the aforementioned variable angle distribution.

The blade loading describes how much energy is transferred by the fan from the relevant blade to the medium being delivered, i.e., for example, air. One geometric indication of the blade loading is the curvature of a blade, i.e. a high blade loading corresponds to a large curvature of the blade.

The curvature of a blade can be accurately surveyed, for example, using a digital coordinate measuring device. This method is unsuitable for a quick check, however. A simple method for measuring the curvature is as follows: provided that all the blades appear the same in meridional section and exhibit the same entrance angle—both of which can be regarded as aerodynamically advantageous—an indication of the curvature can be identified by either measuring the blade chord, or measuring the circumferential dimension of the relevant blade.

What is important here is therefore that the loading per blade is intended to vary. This is identifiable from the fact that at least one of the following conditions is met:

the difference between the largest and smallest circumferential dimension of two blades (measured in degrees [°] where one revolution corresponds to 360°) is at least 0.0010*D (where D is the blade diameter), preferably at least 0.0020*D, and particularly preferably at least 0.0030*D, or the difference between the longest and shortest chord length of two blades (measured at the radially outer edge of the blade) is at least 0.0010*D, preferably at least 0.0020*D, and particularly preferably at least 0.0030*D, where D is once again the blade diameter measured in mm.

This therefore means that every (or almost every) blade within a fan is designed for a slightly varied design point. The result is to produce, in combination with the guidance apparatus, blades that tend more to supply volumetric flow and other blades that tend more to build up pressure. The blade passing noise is thereby reduced to 1/z of the rotation frequency (z=number of blades), and a reduction of approximately 2 dB(A) in the total acoustic power level is obtained.

According to a preferred embodiment at least one of the following conditions is met:

the difference between the largest and smallest circumferential dimension of two blades (measured in degrees [°] where one revolution corresponds to 360°) is at most 0.0700*D (where D is the blade diameter in mm), or the difference between the longest and shortest chord length of two blades (measured at the radially outer edge of the blades) is at most 0.0700*D, where once again D is the blade diameter measured in mm.

The invention is also achieved by means of a fan, such as an axial or diagonal blower, having an impeller which is equipped with a plurality of profiled blades and associated with which is a rotation axis around which it rotates during operation in order to deliver a gaseous medium, in particular air, from a suction side to a discharge side, and having a fan housing surrounding the impeller on its outer side at a distance, air guidance elements being provided at the tip of the blade, which elements form, on the inflow side of the relevant blade, a first region extending toward the suction side and, on the outflow side of the relevant blade, a second region extending toward the discharge side, and form a transition region between the first region and second region, which regions are respectively separated from the fan housing by a tip gap.

In other words, the blades are curved by the air guidance elements toward the suction side on the inflow side, and toward the discharge side on the outflow side.

Preferably the first region, extending toward the suction side, of the blade extends toward the suction side both on the discharge side and on the suction side of the blade. The blade is thus curved there as a whole toward the suction side.

Preferably the second region, extending toward the discharge side, of the blade extends toward the discharge side, both on the discharge side and on the suction side of the blade. The blade is thus curved there, as a whole, toward the discharge side.

BRIEF FIGURE DESCRIPTION

Further details and advantageous refinements of the invention are evident from the exemplifying embodiments described below and depicted in the drawings.

Figure 10:
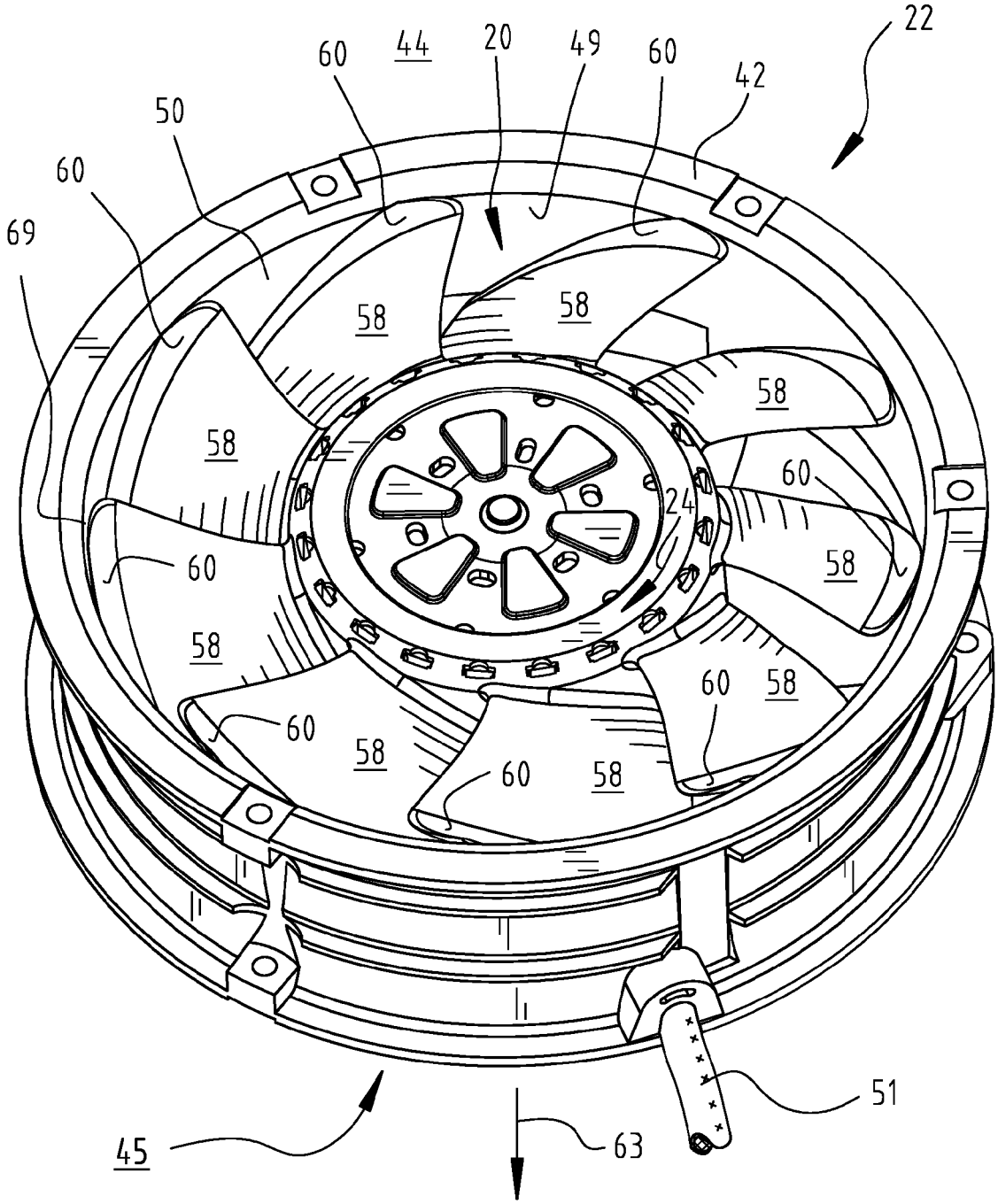
FIG. 10 is a perspective depiction of a second form of the axial blower looking from the air inlet side, i.e. from suction side 44.
Figure 11:
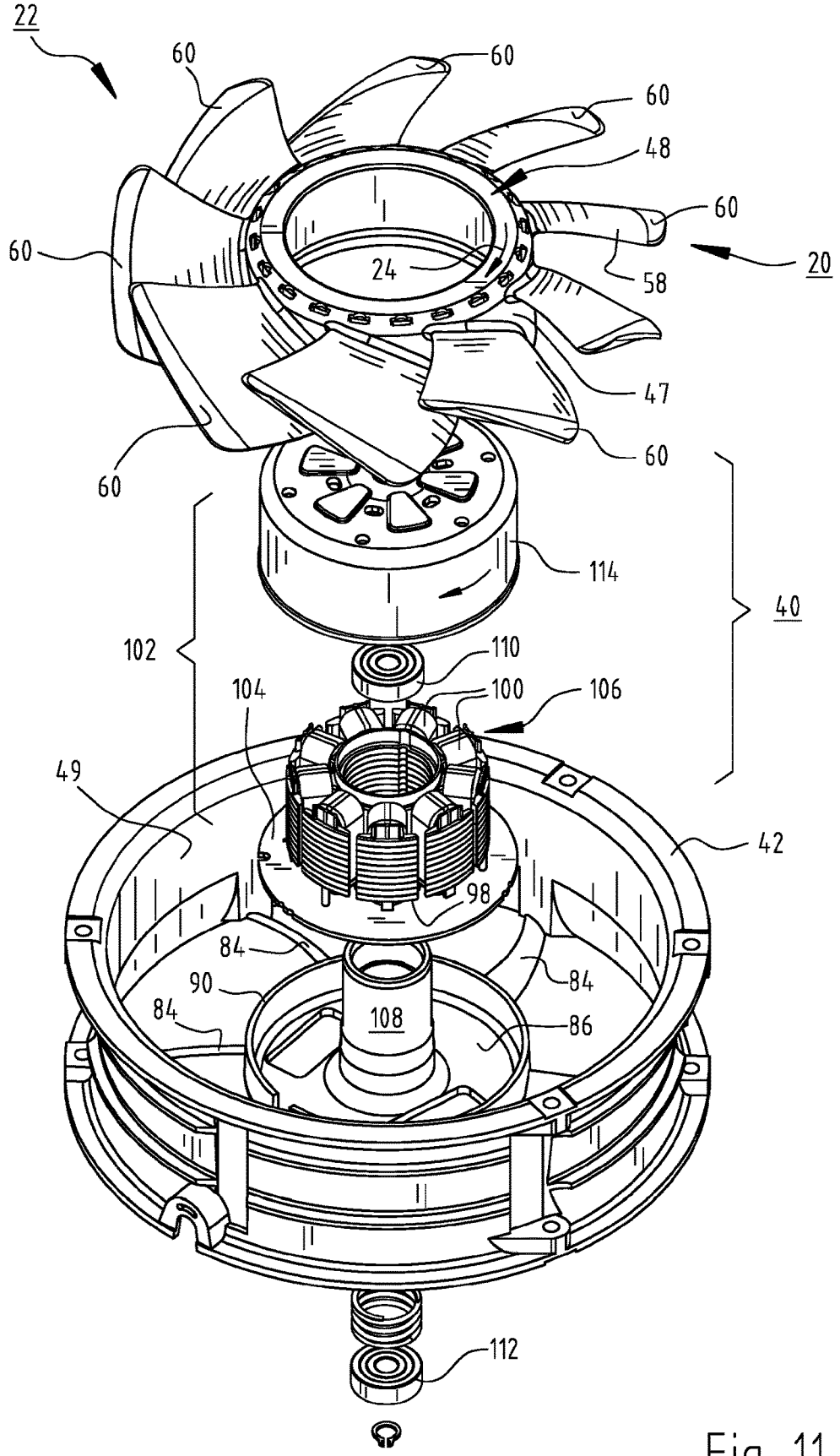
FIG. 11 is an exploded depiction of the axial blower of FIG. 10.
Figure 12:
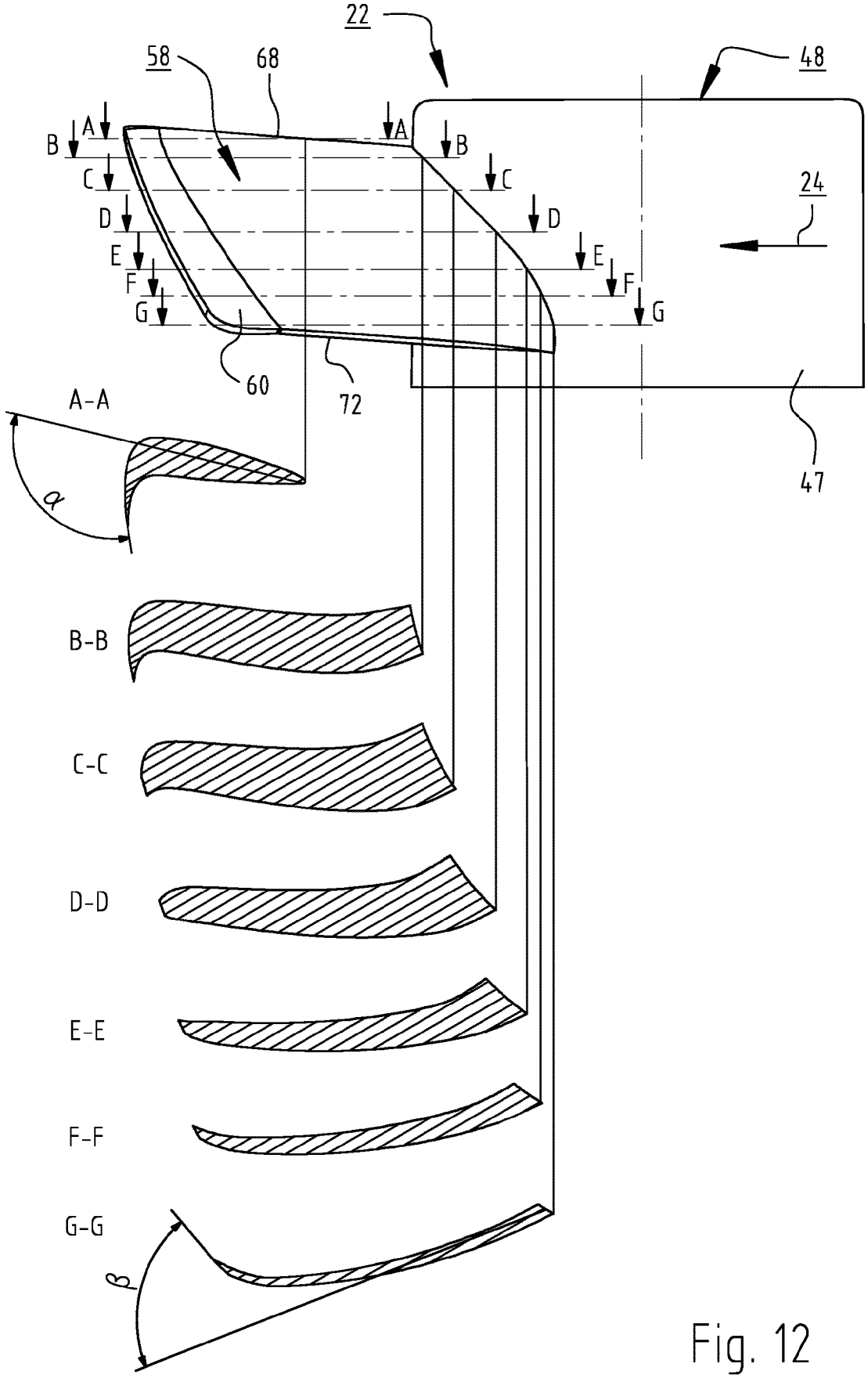
Figure 13:
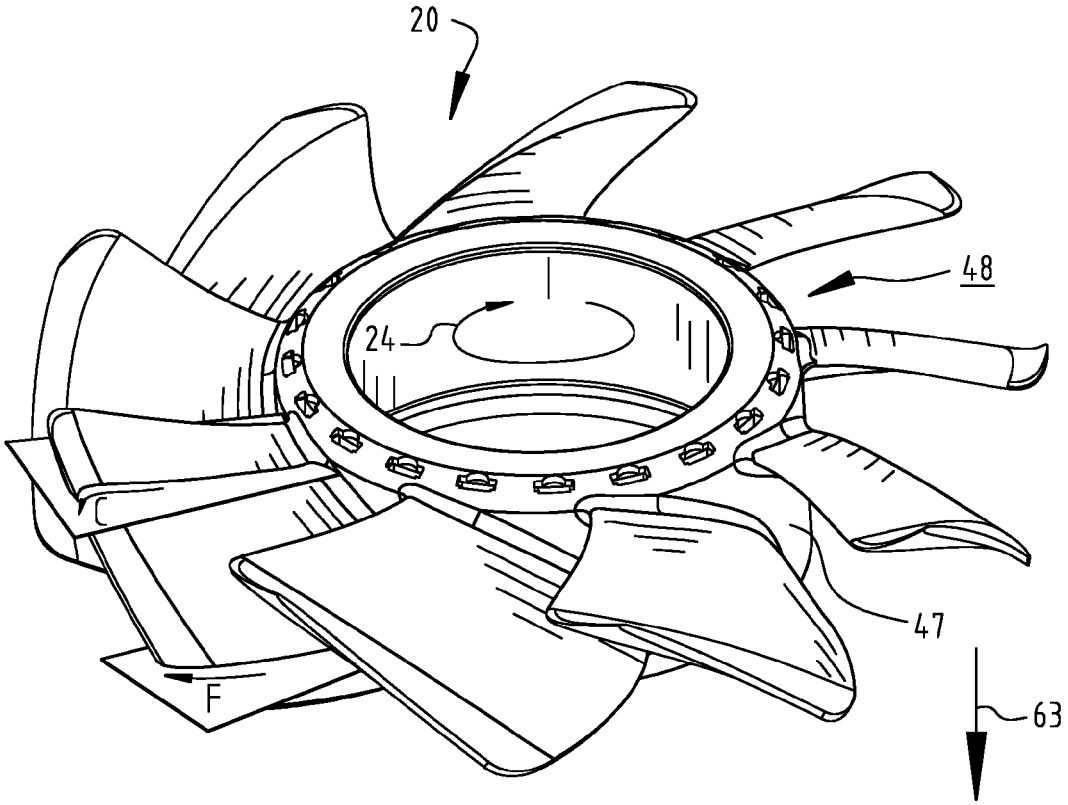
Figure 14:
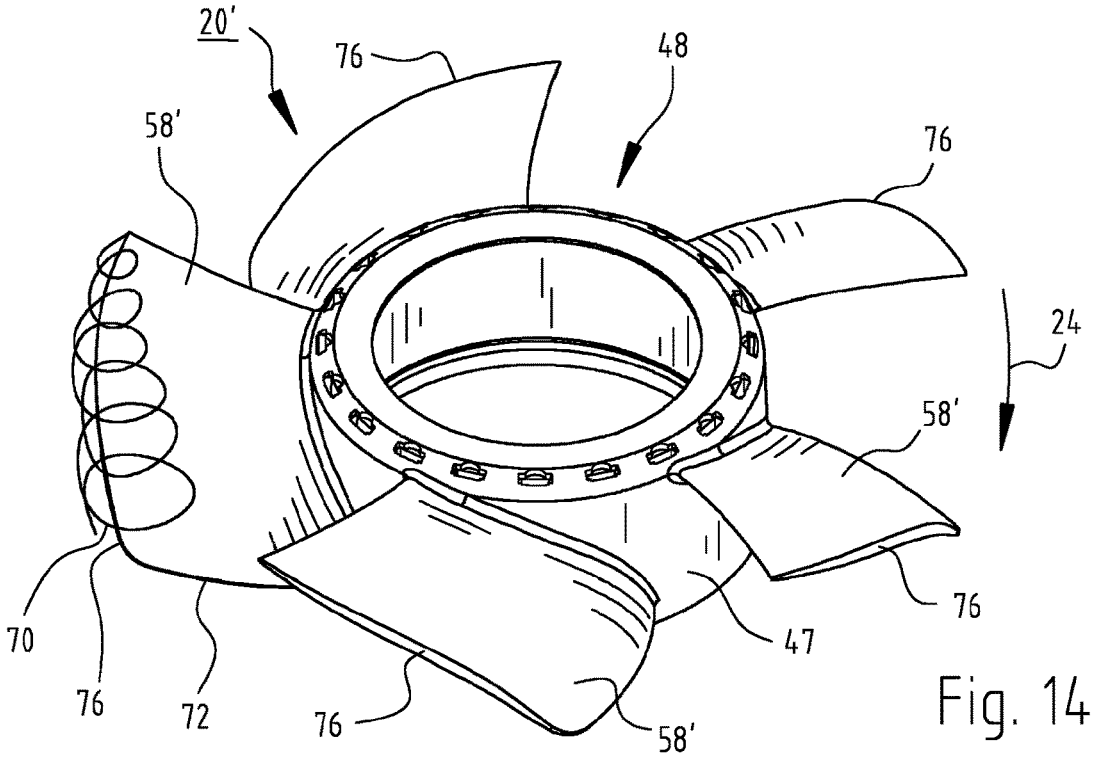
Figure 15:
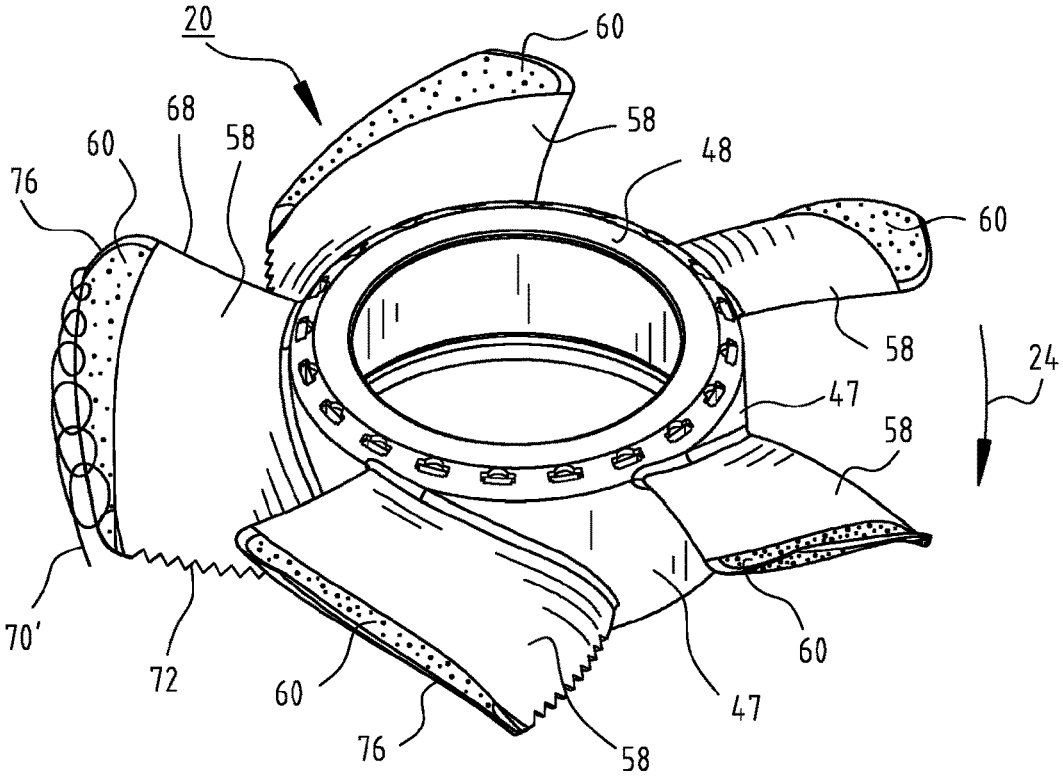
Figure 16:
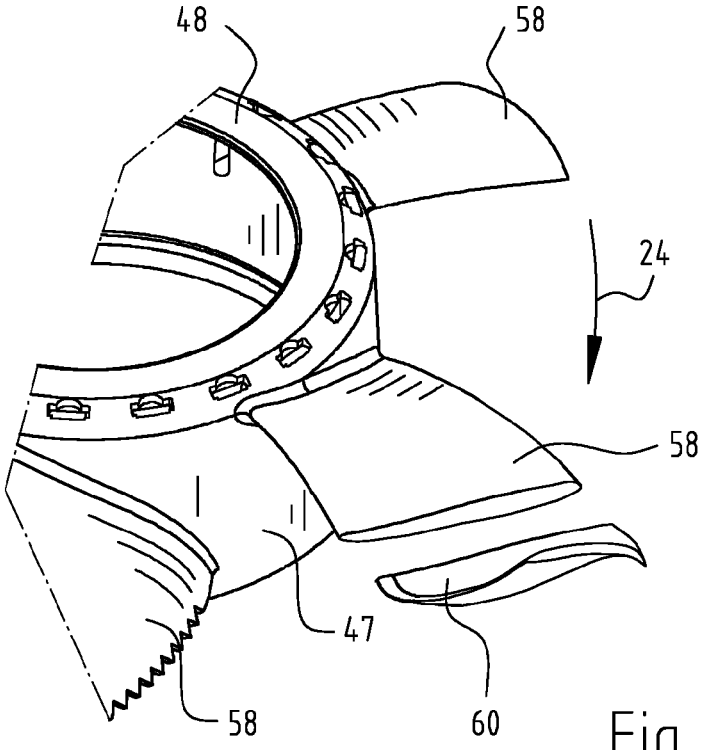
Figure 17:
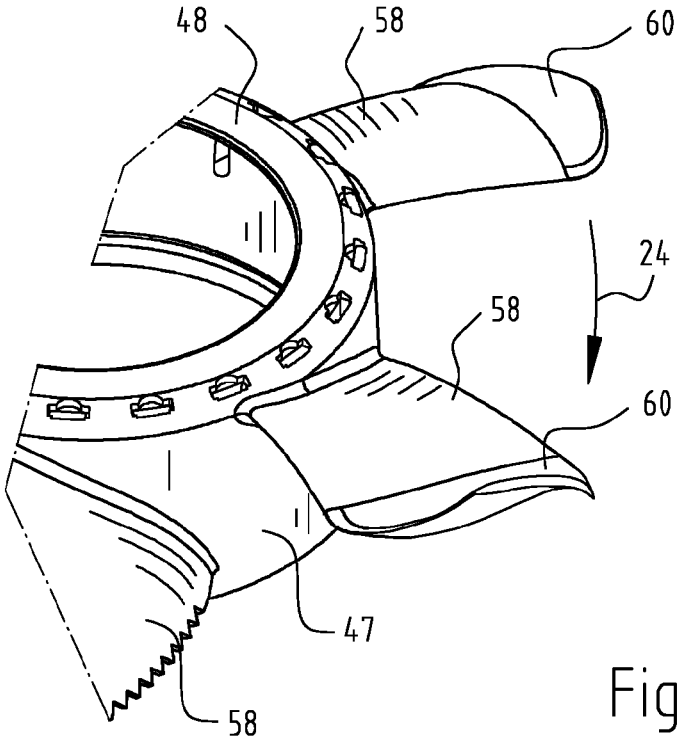
Figure 18:
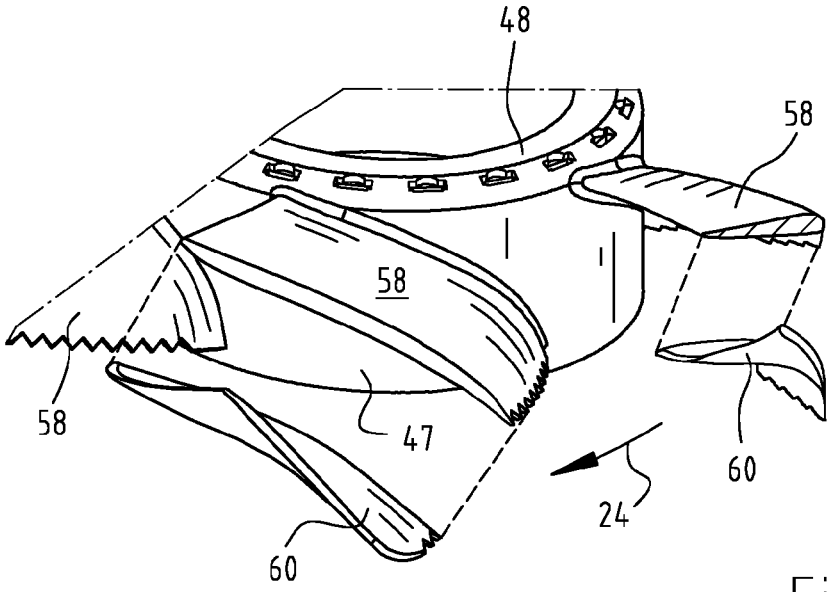
Figure 19:
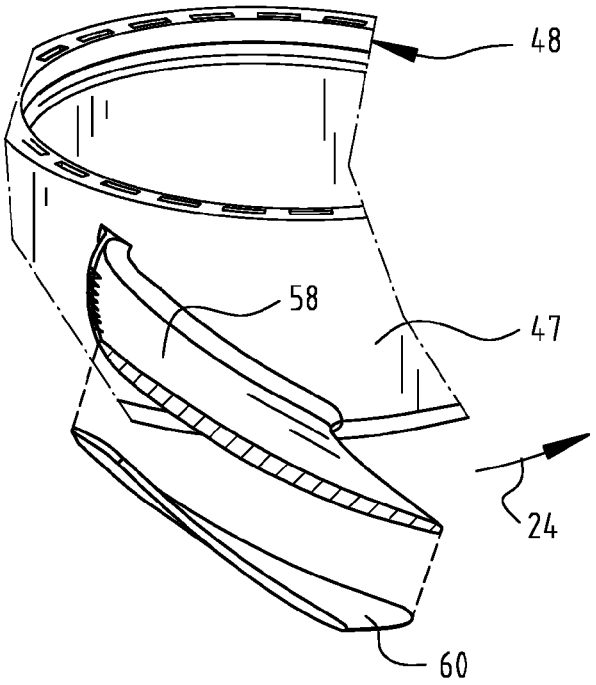
Figure 20:
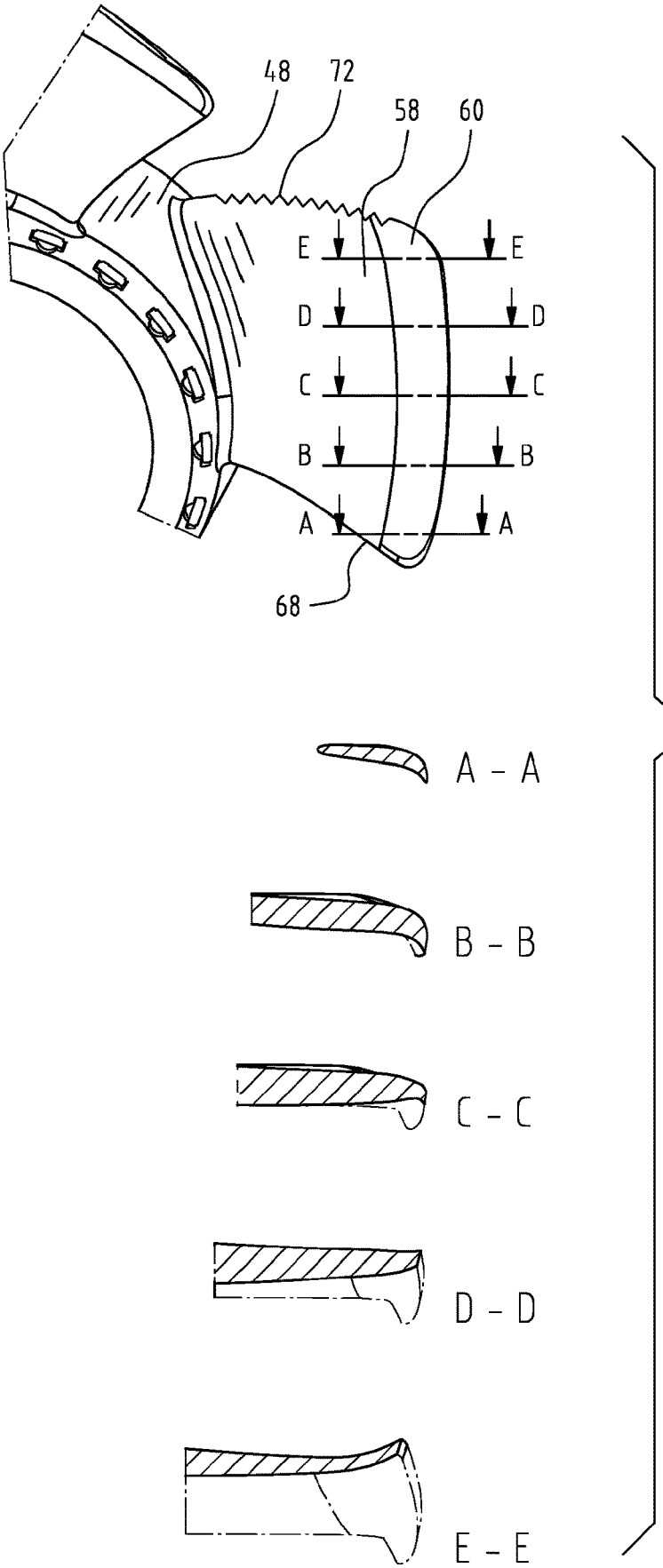

FIG. 12 schematically depicts a blade 58 of the blower (fan) of FIGS. 10 and 11 and associated sections A-A to G-G normal to the axis which illustrate the shape of this blade;

FIG. 13 depicts impeller 20 of fan 22 of FIG. 10 to FIG. 12, the section planes C and F of FIG. 12 being schematically indicated for better comprehension; these are sections depicted normal to the axis, i.e. sections that extend perpendicularly to the rotation axis of impeller 20;

FIG. 14 schematically depicts tip leakage vortex 70 in a fan according to the existing art;

FIG. 15 schematically depicts the reduced tip leakage vortex 70' in the improved embodiment according to the present Application;

FIG. 16 is a perspective depiction of the impeller of FIGS. 10 to 13, the same blade being shown cut off; note that the cut is illustrated only for didactic reasons, and that in reality the blades are implemented for the most part in one piece;

FIG. 17 is a perspective depiction of the impeller of FIG. 16 in an assembled view;

FIG. 18 is a depiction analogous to FIG. 16;

FIG. 19 is a depiction analogous to FIG. 18, although in contrast to FIG. 18 the impeller is shown looking from the discharge side; and FIG. 20 is a depiction of the blade of FIG. 12, but with sections that extend approximately perpendicularly to the blade surface.

DETAILED DESCRIPTION

Figure 1:
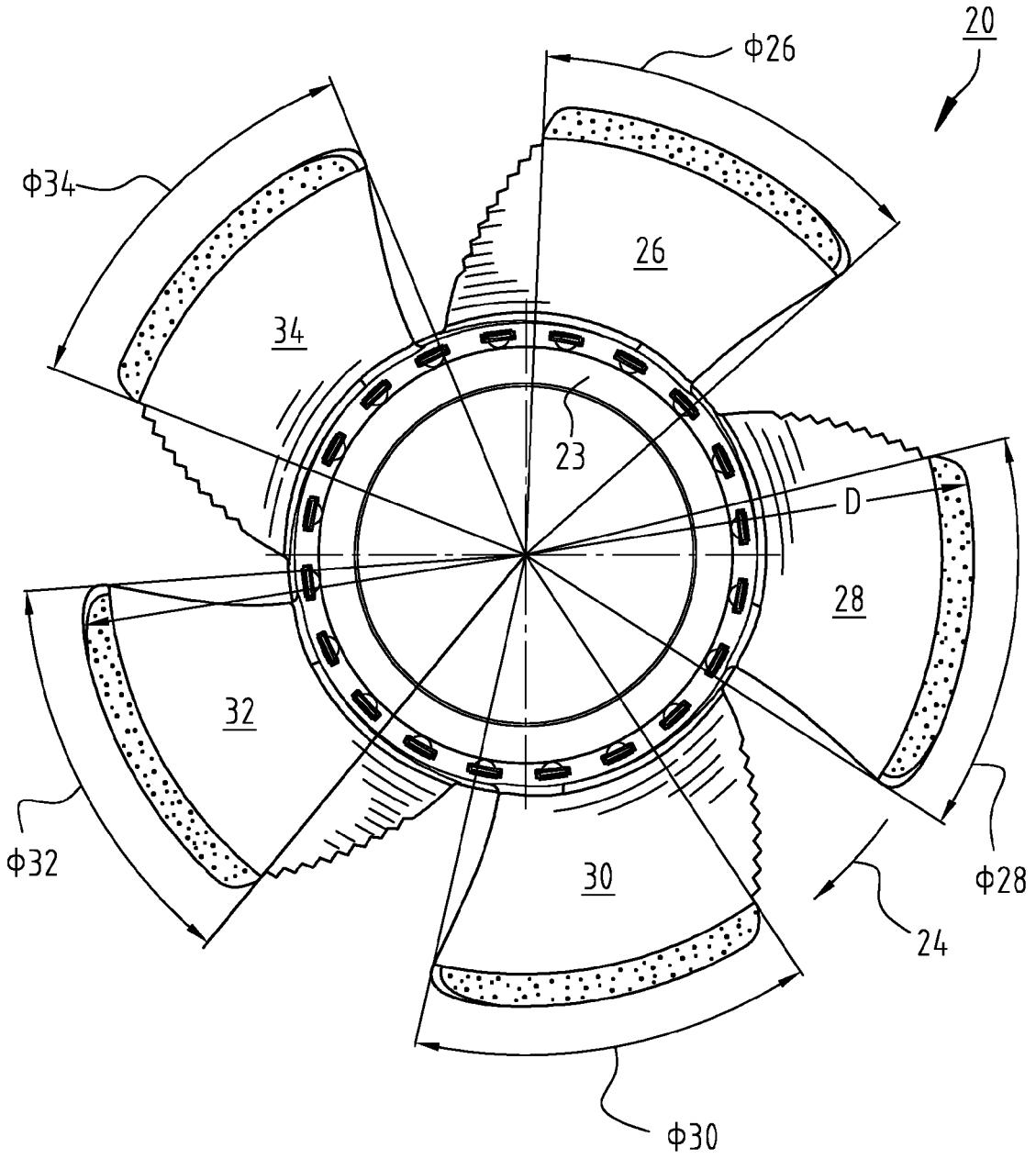
FIG. 1 depicts a first embodiment of an impeller for an axial blower, looking in the direction of arrow I of FIG. 2.
Figure 9:
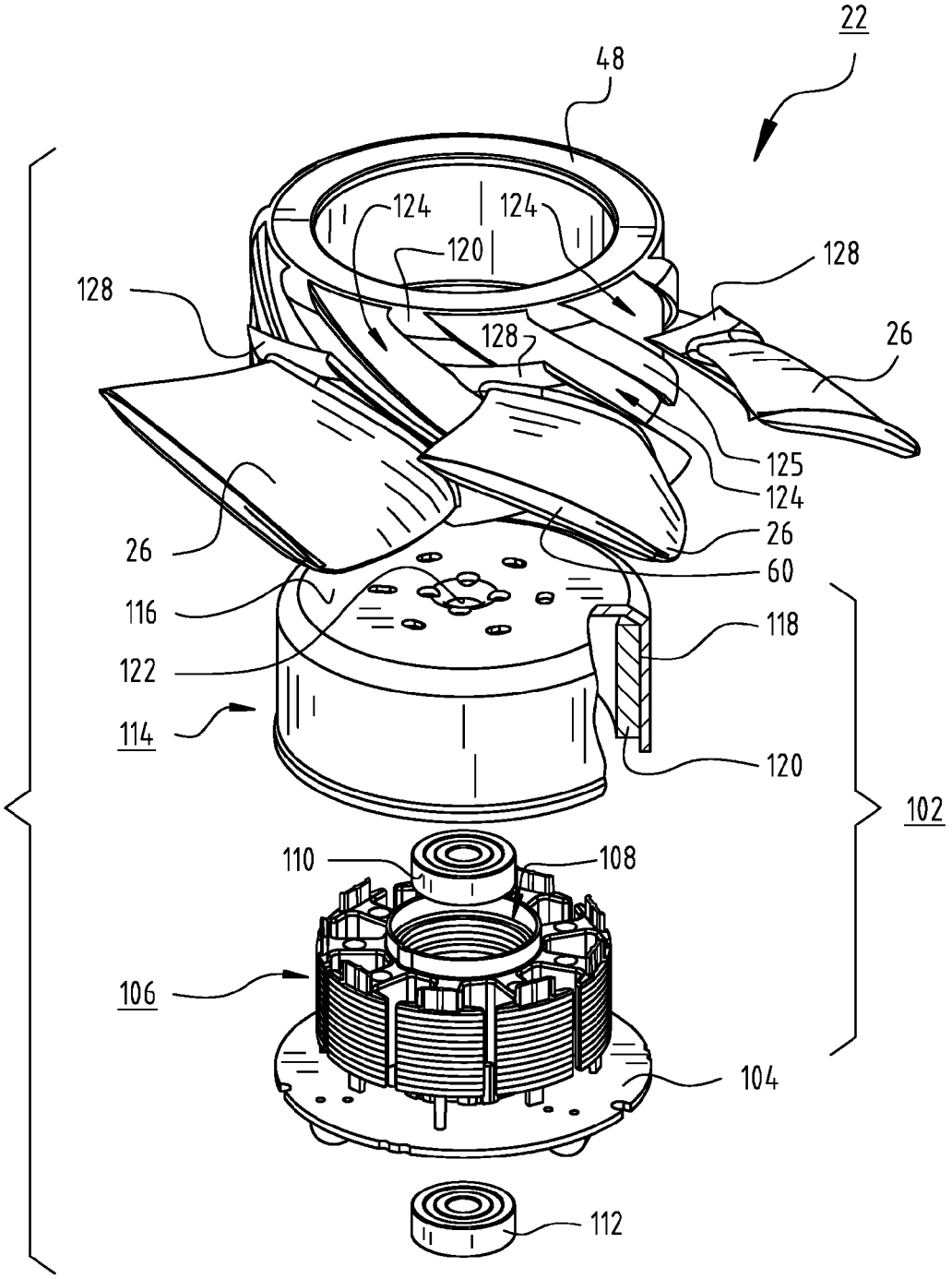
FIG. 9 is an exploded depiction of a fan having elements of an impeller or fan wheel that is designed especially for noise reduction.

FIG. 1 shows an impeller 20 of a fan 22, the parts of which are depicted in FIG. 9 only in part and in a manner that facilitates comprehension by one skilled in the art. Some of the details depicted in FIG. 9 are not shown again in the other figures. An axial fan 22 is depicted, but an implementation as a diagonal (mixed-flow) fan is also possible, i.e. in contrast to radial fans, production of a predominantly non-radial airflow is intended. Impeller 20 rotates, during operation, about a rotation axis 11.

Impeller 20 of FIG. 1, which is also referred to as a "rotor," has five blades (vanes) 26, 28, 30, 32, and 34 that differ slightly from one another in order to achieve a variable blade loading on the various blades. This means that each blade of a fan 22 (FIG. 9) is designed for a slightly varied operating point. The result is that there are blades that supply more volumetric flow, and other blades that build up more pressure. Impeller 20 also has a hub 23 and rotates during operation in the direction of an arrow 24, i.e. here clockwise.

The blades have slightly different angular dimensions φ26 to φ34 in a circumferential direction, measured at their radially outer regions. Blade 26 has the smallest dimension φ26. Blade 28 has the next-largest dimension φ28. Blade 34 has the next-largest dimension φ34. Blade 30 then follows with a dimension φ30, and then blade 32 with a dimension φ32.

Exemplifying numerical values will be indicated for better comprehension. These apply to an impeller having equidistantly arranged blades:

φ26=46.05°
φ28=46.13°
φ30=46.27°
φ32=46.41°
φ34=46.19°

These are therefore small differences in the blade sizes, but in combination they have the effect of reducing the amplitude of the BPF by 2 dB(A). The reason is that, thanks to variable configuration of the blade loading on each individual blade of a blower, each blade is exposed to different flow conditions. This produces a number of differently configured pressure fluctuations that rotate synchronously with one another, and at a frequency n.

If it is assumed that fan 22 has a number z of blades, the rotation of impeller 20 then produces a number z of differently configured pressure fluctuations that rotate synchronously at the rotation frequency of the rotor. In contrast to a conventionally constructed rotor, this means the following:

z pressure fluctuations having different amplitudes now appear.

The individual pressure fluctuations rotate at the frequency n, i.e. at the rotation speed of rotor 20 (measured in revolutions per second).

This produces a reduction in the frequency of the blade-passing noise (BPF) by a factor of 1/z. The blade passing noise is thereby advantageously shifted, for the most part, into a frequency range to which the human ear is less sensitive. (This aspect is also taken into account by the A-weighting of the acoustic power level.)

Figure 4:
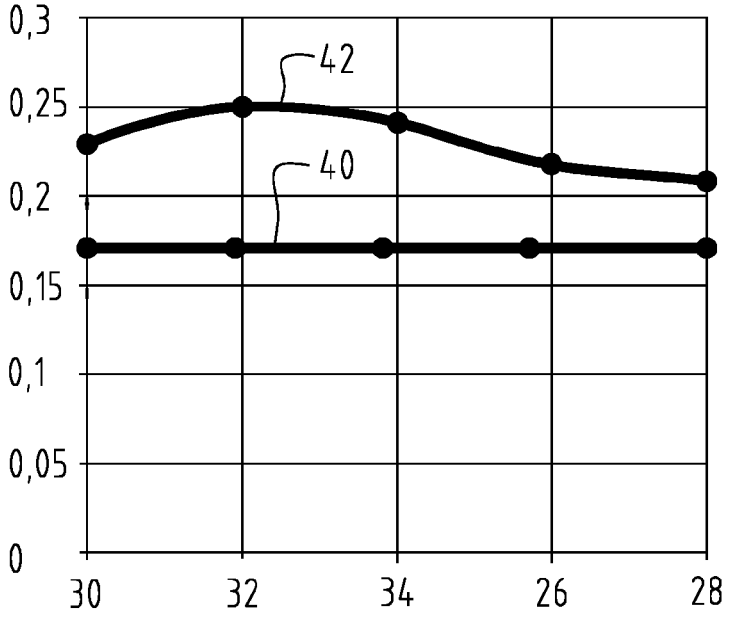
FIG. 4 depicts the blade loading in the context of the impeller of FIG. 2 that has five blades 26, 28, 30, 32, 34.

FIG. 4 shows the blade loading 40 at hub 23 and the blade loading 42 at the casing ring, plotted against the individual blades 30, 32, 34, 26, and 28. The "casing ring" is understood as the outer region of the blades in which the circumferential speed, and thus also the loading, is higher than at the hub. For efficient reduction of the blade-passing noise, it has proven to be useful to distribute the blade loading per blade sinusoidally in a circumferential direction, as depicted in FIG. 4 for a fan having five blades.

The result of the variable blade loading is that the frequencies associated with the blade passing noise can be distributed over a broader spectrum than would be possible using a variable angle distribution of the blades, in which the distances between the blades are varied.

It is apparent from FIG. 4 that the maximum blade loading occurs on blade 32 and the minimum loading on blade 28.

Simple Measurement of Blade Loading

The blade loading describes how much energy is transferred by fan 22 from a blade to the delivered medium. A geometric indication of the blade loading is the curvature of the relevant blade, i.e. a large curvature corresponds to a high blade loading. The curvature of a blade can only be accurately surveyed using a digital coordinate measuring device. This method is unsuitable for a quick check, however.

A simple method for measuring the curvature is as follows: Provided all the blades appear the same in meridional section (as depicted in FIG. 3) and exhibit the same entrance angle (δ)—both of which are aerodynamically advantageous—an indication of the curvature can be identified by either measuring the blade chord (46 in FIG. 2) or measuring the circumferential dimension of the relevant blade, as depicted in FIG. 1.

Figure 2:
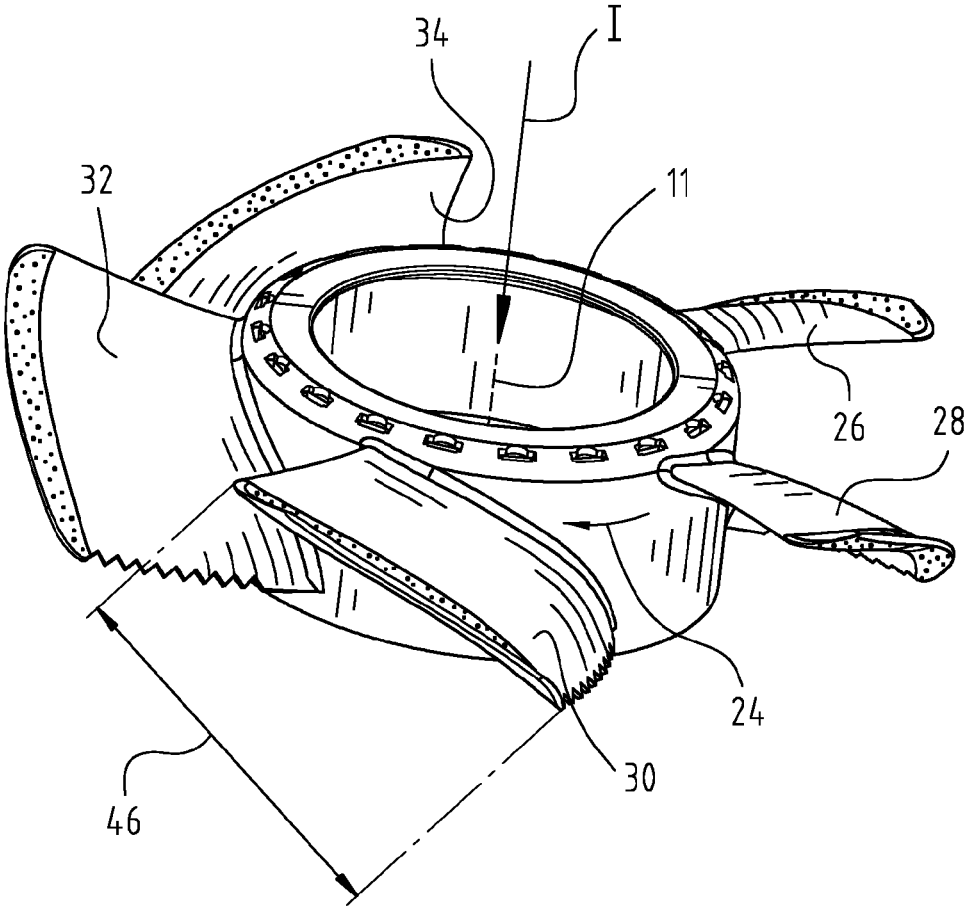
FIG. 2 is a perspective depiction of the impeller of FIG. 1.
Figure 3:
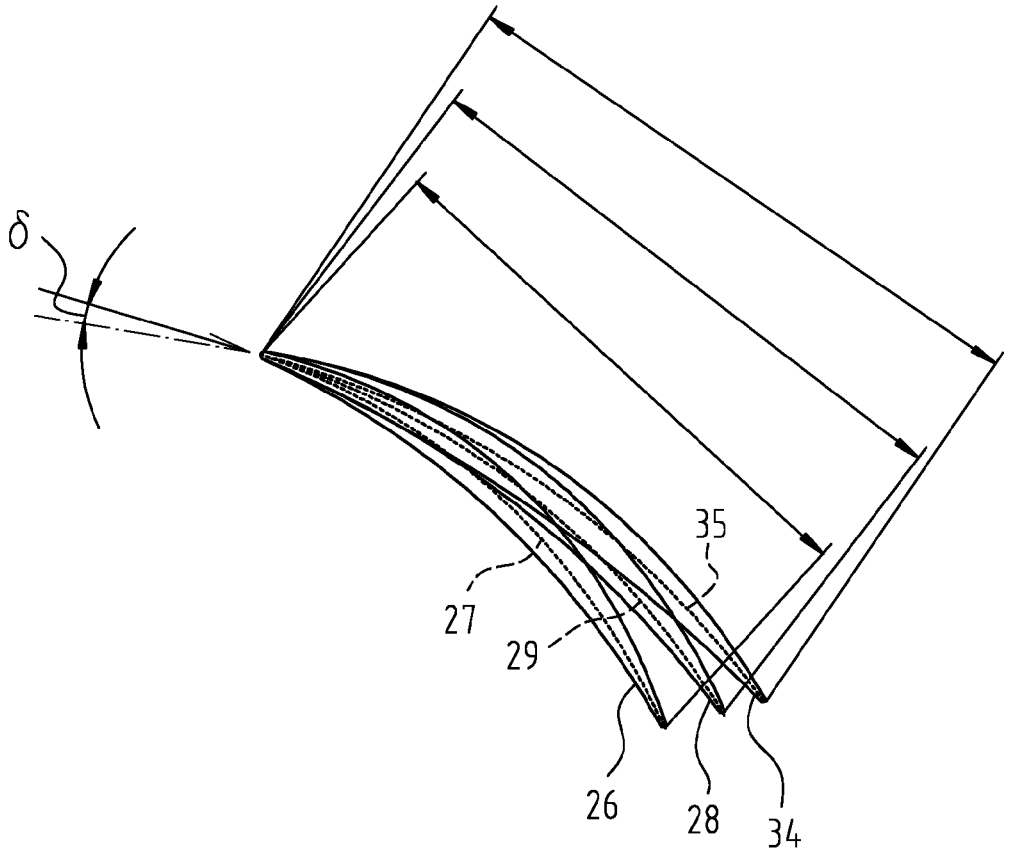
FIG. 3 is a section through three blades (fan vanes) having different chord lengths.

FIG. 2 shows chord 46 of blade 30. The length of said chord is easy to measure. FIG. 3 shows meridional sections through three blades 26, 28, 34, and chords 27, 29, 35 of those three blades. Chord 35 of blade 34 is the longest and results in a higher blade loading. The entrance angle (δ) at which air enters a blade is approximately the same for all three blades 26, 28, 34.

The objective is thus a loading that varies for each blade, and this is identifiable from the fact that at least one of the following conditions is met:

the difference between the largest and smallest circumferential dimension of the blades, measured in degrees, is at least 0.0010*D, preferably at least 0.0020*D, and particularly preferably at least 0.0030*D, where D is the diameter of the impeller in mm, as indicated in FIG. 1, or the difference between the longest and shortest chord length of two blades, measured at the outer edge of the blade, is at least 0.0010*D, preferably at least 0.0020*D, and particularly preferably at least 0.0030*D.

In the present case D=150 mm, and therefore 0.0010*D (mm)=0.1500.

The difference between the largest circumferential dimension φ32 and smallest circumferential dimension φ26 of the blades is $$\varphi 32-\varphi 26=46.41°-46.05°=0.36.$$

This is greater than 0.0020*D=0.300.

It has been found, in experiments, that an appreciable reduction in blade-passing noise is already achievable with a difference between the largest and smallest circumferential dimension or chord length of at least 0.0010*D; a further reduction in blade passing noise occurs at a difference of 0.0020*D; and an even greater reduction in blade-passing noise can occur at a difference of 0.0030*D (in particular when the chord length is considered), this being dependent on the design point for the fan.

Too great a difference between the largest and smallest circumferential dimension or chord length, however, can have a negative effect. It is supposed that what occurs here is an interference with the aerodynamics between the adjacent blades, especially when a blade that builds up a high pressure is arranged next to a blade that generates a large volumetric flow. It is advantageous, for this reason, to arrange the blades in such a way that a wave-shaped blade loading is produced (see FIG. 4).

A corresponding value of 0.0700*D has proven to be advantageous as an upper limit for the difference between the largest and smallest circumferential dimension or chord length, the exact upper limit being dependent on the design point of the fan.

Optional Use of Teeth on the Trailing Edge

As FIG. 1 shows, rows of teeth extending in the manner of a saw (serrations) are preferably provided on the trailing edges. These likewise bring about a reduction in the acoustic power level, since these teeth prevent hard impacts between the flows from either side of a blade. The reason is that the air flows from the discharge side and from the suction side of the fan encounter one another at the trailing edge and can generate vortices and noise when they strike the webs of the fan. The teeth reduce these vortices.

Figure 5:
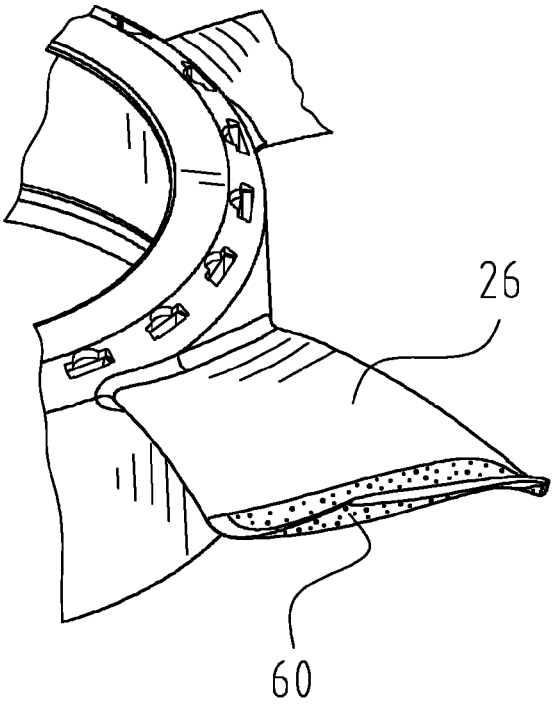
FIG. 5 is a perspective depiction of blades that are equipped with very advantageous guidance elements.
Figure 6:
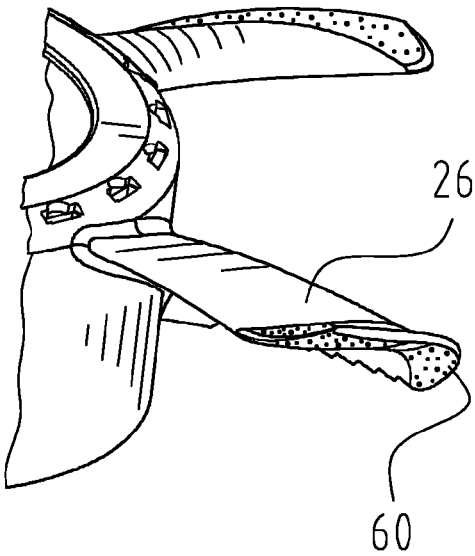
FIG. 6 is a further perspective depiction of the blades of FIG. 5.

FIG. 5 and FIG. 6 show the use of a preferred air guidance element (flow element) 60 that is mounted on the radially outer blade edge of blade 26 and of the other blades, and is adapted to the pressure buildup on the outer edge of the blade.

The preferred air guidance element 60 is described in more detail below.

Overall Construction of the Fan

Figure 7:
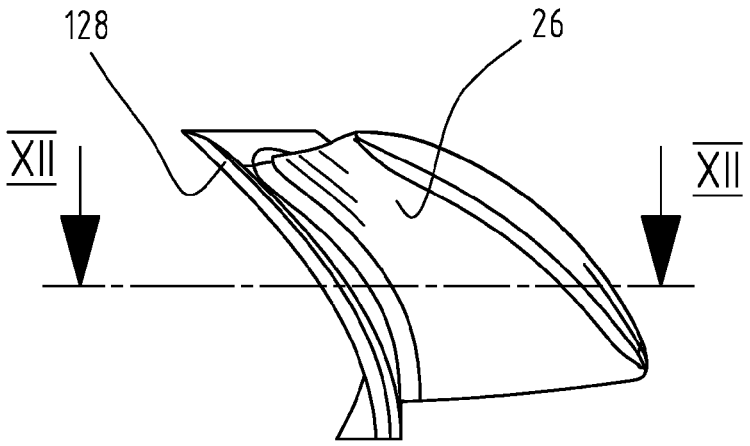
FIG. 7 shows a blade as a separate component for mounting on a base element as depicted by way of example in FIG. 9.
Figure 8:
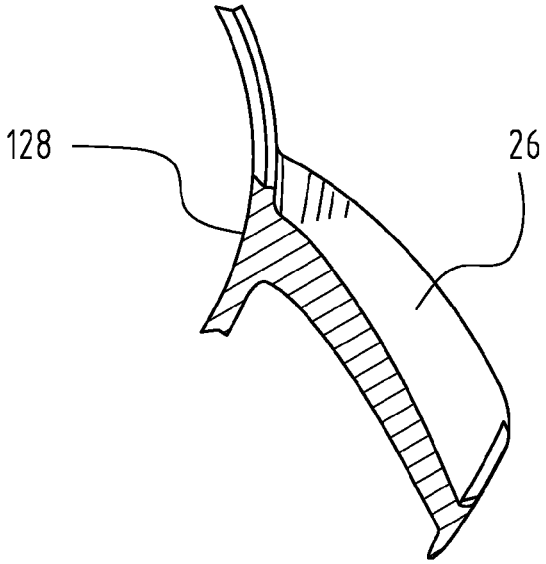
FIG. 8 is a section looking along line VIII-VIII of FIG. 7.

FIGS. 7 to 9 show a preferred construction of fan 22 driven (by way of example) by an external-rotor motor 102.

Internal stator 106 of motor 102 is arranged on a circuit board 104 where electronic components of motor 102 are located. The latter has, in its central region, a bearing tube 108 in which are located two ball bearings 110, 112 that serve for journaling a shaft (not visible in the perspective selected) of an external rotor 114 that rotates, during operation, around internal stator 106.

The exemplifying external rotor 114 has a cup-shaped ferromagnetic yoke 116 in whose edge 118 a radially magnetized permanent magnet 120 is mounted. The number 122 designates a site at which the shaft (not shown) of the rotor is mounted on the inner side of rotor cup 116.

Hub 120 of impeller 22 is mounted on rotor cup 116. Hub 120 has, on its outer side, obliquely extending channels 124 that, in the present exemplifying embodiment, have a dovetail-shaped cross section; a different shape of channel 124 is also possible, for example with a slight undercut. Blades 26 (depicted only schematically) analogously have a base plate 128 that fits into an associated channel and is mounted therein upon assembly. Projections 125 can be provided between channels 124.

Channels 124 make it possible to mount blades 26 of different types, for example (as shown in FIG. 1) blades 26 to 36 having different sizes, on the circumference of hub 120, in order to achieve variable loading of the individual blades 26 to 34 and thereby reduce the blade-passing noise.

It is, of course, also possible to manufacture hub 120 and the blades associated with it, for example, as an integral injection molded part, but the use of individual blades having varying properties has the advantage that these blades can be manufactured, and optionally also post-processed, particularly precisely, whereas with an integral component the desired precision can be impaired by small differences in the context of manufacture (cavities in the plastic, different material thicknesses due to shrinkage, etc.) so that it becomes more difficult to implement, in practice, the desired improved properties of such a fan. Be it noted that only three of the five fan blades 26 are depicted in FIG. 9.

Use of Specially Implemented Air Guidance Elements at the Edge of the Blades

FIG. 10 is a perspective depiction of a second embodiment of the fan (axial blower) 22, and FIG. 11 is a schematic exploded depiction of parts of such a fan, in order to facilitate comprehension. The embodiment according to FIG. 10 differs from the embodiment of FIG. 1 in particular in terms of a different number of blades.

Fan 22 of FIG. 10 has nine blades 58, and fan 22 of FIG. 1 has five blades 26, 28, 30, 32, 34.

Fan 22 has a housing 42 in which an impeller 20 (also referred to as a "fan rotor") is arranged. Housing 42 is preferably venturi-shaped on its inner side. Its suction side is labeled 44 and its discharge side 45. An electrical connector lead 51 is arranged on the lower part of housing 42.

Impeller 20 has a hub 48 on which (in this example) nine overlapping blades 58 are arranged. These can have different angular distances and different curvatures, as described above. On their outer periphery, these blades 58 have special air guidance elements 60 having a particular shape that will be described in further detail with reference to the Figures that follow. Air guidance elements 60 can also be referred to, because of their shape, as "overshot" flow elements. Air guidance elements 60 reduce the noise generated by fan 22 during operation, and also increase the pressure generated by fan 22. The inner wall of air channel 50 is formed by the approximately cylindrical outer side 47 of hub 48 (FIG. 11), and its outer wall is formed by inner wall 49 of housing 42.

Blades 58 are mounted on outer side 47 of hub 48. They rotate in the direction of an arrow 24, i.e. clockwise. The flow direction of the air is indicated by an arrow 63, i.e. proceeds from top to bottom in FIG. 10, namely from suction side 44 to discharge side 45.

FIG. 12 shows, at the top, hub 48 of fan 22 and a blade 58 provided on it with section lines A-A to G-G, and the corresponding sections A-A to G-G through blades 58 normal to the axis are depicted at the bottom. Sections "normal to the axis" are sections that extend perpendicularly to the rotation axis of the rotor.

Blades 58 are respectively implemented at their periphery as an air guidance element 60, or comprise such an element. Hub 48 rotates during operation in the direction of arrow 24, and therefore the front blade edge is leading edge 68 and the rear blade edge is trailing edge 72.

In the region of leading edge 68, air guidance element 60 is curved at an angle α (alpha) toward suction side 44 (see section A-A). This curvature toward suction side 44 is also clearly evident from the sections B-B and C-C.

In the middle portion (with reference to the circumference) of blade 58, i.e. in the region of sections D-D and E-E, air guidance element 66 substantially follows the shape of blade 58, i.e. acts as an outward continuation of blade 58, as is also graphically evident from sections D-D and E-E.

In the region of trailing edge 72, i.e. at sections F-F and G-G, air guidance element 60 is curved at an angle β (beta) toward discharge side 45. The cross section of blade 58 thus looks different at inlet 58 than at outlet 72.

The angle alpha is preferably in the range between 105° and 130°, more preferably in the range between 115° and 125°; particularly preferably it is 120°. The angle beta is preferably in the range between 65° and 95°, more preferably in the range between 70° and 90°, and particularly preferably it is 80°. The angle indications are given in degrees.

In other words, the radius of curvature of air guidance element 60 at leading edge 68 differs greatly from the radius of curvature at trailing edge 72.

It has proven to be positive in terms of performance, and with regard to noise, if the maximum angle alpha is greater than the maximum angle beta.

Air guidance element 60 can also be referred to as a "conical flow element." This term derives from the fact that corresponding curves having different radii result, when a (double) cone is sectioned along various parallel planes.

Be it noted that the region of air guidance element 60 is approximately in the shape of an "edge strip" at the outer edge of blade 58, as shown by FIG. 12.

FIG. 13 shows, in perspective, the contour of this edge strip. Its contour can be simulated by cutting a thin strip of heavy paper, then grasping it at both longitudinal ends and twisting it by rotation in opposite directions. The air guidance element can also be used, however, without this rotation, or directed only to one side.

FIG. 13 furthermore shows, by way of example, the section planes C and F for sections C-C and F-F.

FIGS. 16 to 19 show this shape in perspective from different angles of view.

FIG. 20 shows blade 58 and sections A-A to E-E through it, the sections being approximately perpendicular to the surface of blade 58. The sections are respectively viewed from above, as indicated by the arrow on the section lines. The right, or radially outer, regions of blade 58 are also depicted on the right in the sections, so that it is apparent that air guidance element 60 is curved toward the suction side in the front sections A-A, B-B, and C-C, and that it is curved toward the discharge side in the rear sections D-D and E-E. It is further evident, from the section E-E, that in the rear region the air guidance element extends toward the discharge side and in the front region, it extends toward the suction side, i.e. that it is implemented in twisted fashion.

Effect of the Air Guidance Elements

FIG. 14 shows an impeller 20' having no air guidance elements 60. In an axial or diagonal fan, pressure is continuously built up along the blade length during operation.

Conventional designs for the air guidance elements are not adapted to this, since they exhibit a uniform cross section of the flow elements over the entire blade length. In particular, it was hitherto usual to select the radius of curvature of the flow elements to be the same over the entire contour. As FIG. 14 shows, the result is that the intensity of the tip leakage vortex increases toward the trailing edge, i.e. noise production increases, which is undesirable.

FIG. 15 shows impeller 20 having air guidance elements 60. What is achieved, thanks to the construction of air guidance elements 60 as shown, is that the pressure along air guidance element 60 rises uniformly. The result is that the so-called "tip leakage vortex" 70, i.e. the vortex that is produced in gap 69 (FIG. 10) between outer edge 76 of a blade 58 (FIG. 14) and inner side 49 of housing 42, and that is depicted in FIG. 14 for a blade 58' having no air guidance element, can be reduced. In a fan according to FIG. 14 whose blades 58' are depicted without an air guidance element, a strong tip leakage vortex 70 is produced, bringing about corresponding noise emission.

In addition, a pronounced tip leakage vortex 70 also strikes (collides with) the following blade and also causes it to vibrate. Air guidance elements 60, that are shown, are thus adapted to the pressure buildup at the outer edge of the associated blade 58.

In a practical experiment with a fan 22, whose impeller 20 has a diameter of 150 mm, a pressure gain of approximately 15% was obtained, as compared with a fan of the same size having no air guidance elements 60, i.e. the novel fan generated a higher pressure; and a reduction in acoustic power level of approximately 1.5 dB(A) was obtained, i.e. the fan ran more quietly despite the higher pressure. These are valuable practical improvements.

The implementation of air guidance element 60 as described thus produces a smaller tip leakage vortex 70' as depicted schematically in FIG. 15.

A change in the curvature of air guidance element 60 furthermore influences the deformation properties of blade 58 in response to centrifugal force, i.e. during operation. The result is that blade 58 deforms more intensely in the region of its trailing edge 72, where a higher pressure exists, than in the region of leading edge 68. Optimized sealing is thus obtained there, in terms of the flow around blade 58 through tip gap 69, as well as correspondingly higher efficiency.

In other words, the air guidance elements can have, in particular, the following effect:

Modifying the curvature of the flow element advantageously influences the flow in the tip gap, which is depicted in FIG. 15 and is referred to as a "tip leakage vortex." FIG. 14 shows the tip leakage vortex without the use of a flow element. FIG. 15 shows tip leakage vortex 70' when air guidance element 60 is used. A very pronounced tip leakage vortex 70 has a negative effect on the acoustic properties of the fan, since this vortex 70 strikes the following blade and excites it to vibrate.

The change in the curvature of the flow element influences the deformation properties of blades 58 in response to centrifugal force. Blade 58 thereby becomes more deformed in the region of trailing edge 72, where a high pressure exists, than in the region of the leading edge. This means optimized sealing against a surrounding airflow through the tip gap. This has a very positive effect, especially for high-output fans.

Both effects have led to considerably improved performance and to a reduction in noise.

FIG. 11 is an exploded depiction (for better comprehension) of fan 22. The construction corresponds fundamentally to the construction of the exemplifying embodiment of FIG. 9, and the additionally depicted elements will be discussed below. Shown at the bottom of FIG. 11 is fan housing 42 in which is mounted, by means of struts 84, a support flange 86 in the middle of which is attached a bearing tube 108 that is usually implemented in one piece with support flange 86. The latter has a circumferential, upwardly projecting rim 90.

Depicted above support flange 86 is circuit board 104, on which electronic components (not depicted) of fan 22 can be arranged. Internal stator 106 of external-rotor motor 102 is mounted on the upper side of circuit board 104, said stator having (in this example) nine salient poles 98 that are wound with a three-phase winding whose coils are labeled 100.

The design of motor 102 is of secondary importance in the context of the invention. A three-phase motor operated at 50 or 60 Hz would in some cases be too slow, and for that reason a single-phase or three-phase electronically commutated motor (ECM) is usually the better solution, since higher rotation speeds are also possible with this, and the rotation speed is adjustable or can even be regulated.

Combination of the Aerodynamic Features

Experiments were carried out in which both a variable angle distribution and the above-described air guidance elements 60 were used. The combination resulted in a particularly quiet and high-output fan that was better in those respects than known fans of the same size. The use of teeth (serrations) on the trailing edge resulted in a further improvement.

Numerous variants and modifications are possible in the context of the present invention.

The figures and the description show a fan, in particular an axial or diagonal fan, having an impeller 20 that is equipped with a plurality of profiled blades 26, 28, 30, 32, 34; 58 and rotates around a rotation axis during operation; and having a fan housing 42 surrounding impeller 120 on its outer side at a distance, blades 26, 28, 30, 32, 34, 58 being implemented so that the blade loading of the individual blades differs during operation.

The loading associated with the individual blades is preferably distributed sinusoidally in a circumferential direction.

Preferably the angular difference $\Delta\varphi$ between the largest and smallest circumferential dimension of two blades is at least 0.0010*D, more preferably at least 0.0020*D, particularly preferably at least 0.0030*D, where D=diameter of the impeller, measured in mm;

$\Delta\varphi$=angular difference between the largest and smallest circumferential dimension of two blades, measured in degrees.

Preferably the difference between the longest and shortest chord length 27, 29, 35 of the blades, measured in each case at their outer edge, is at least 0.0010*D, more preferably at least 0.0020*D, particularly preferably at least 0.0030*D, where D=diameter of the impeller, measured in mm, and chord length measured in mm.

Preferably blades 58; 26, 28, 30, 32, 34 are respectively equipped, at their end facing toward fan housing 42, with an air guidance element 60, a tip gap 69 being provided between air guidance element 60 and fan housing 42.

Preferably air guidance elements 60 are implemented in twisted fashion. Preferably a twisted air guidance element 60 is twisted toward suction side 44 on the inflow side of the relevant blade, and toward discharge side 45 on the outflow side of the relevant blade.

Preferably that region of air guidance element 60 which is twisted toward discharge side 45 is implemented elastically, in order to enable an elastic deformation of that region toward fan housing 42 during operation and to counteract flow around air guidance element 60 through tip gap 69.

Preferably air guidance elements 60 are implemented so that a continuous pressure buildup from the inflow side toward the outflow side of the relevant blade 26, 28, 30, 32, 34; 58 occurs in tip gap 69 between air guidance element 60 and fan housing 42.

Preferably all blades 58; 26, 28, 30, 32, 34 have the same entrance angle $\delta$ at leading edge 68.

The drawings and the description show a fan such as an axial or diagonal blower, having an impeller 20 which is equipped with a plurality of profiled blades 26, 28, 30, 32, 34; 58 and which has, associated with it, a rotation axis 11 around which it rotates during operation in order to deliver a gaseous medium, in particular air, from a suction side 44 to a discharge side 45; and having a fan housing 42 surrounding impeller 20 on its outer side at a distance, air guidance elements 60 being provided at the tips of blades 26, 28, 30, 32, 34; 58, which elements form on the inflow side of the relevant blade 26, 28, 30, 32, 34; 58 a first region extending toward suction side 44, and on the outflow side of the relevant blade a second region extending toward discharge side 45, as well as a transition region between the first region and second region, which regions are respectively separated from the fan housing 42 by a tip gap 69.

Preferably air guidance element 60 is respectively implemented in the manner of an edge strip for the radially outer edge of the associated blade 26, 28, 30, 32, 34; 58.

Preferably air guidance elements 60 have a curvature that is different at one end of the air guidance element from the curvature at the other end of the air guidance element. Preferably the air guidance element is implemented elastically on the outflow side of blade 26, 28, 30, 32, 34; 58, in such a way that blade 26, 28, 30, 32, 34; 58 deforms in such a way that it reduces there a flow around blade 26, 28, 30, 32, 34; 58 through tip gap 69. Preferably, on the inflow side of the relevant blade 26, 28, 30, 32, 34; 58 the angle $\alpha$ between the radial contour of blade 26, 28, 30, 32, 34; 58 and the contour of the associated flow element 60 is in the range between 105° and 130°.

Preferably, on the outflow side of the relevant blade 26, 28, 30, 32, 34; 58, the angle $\beta$ between the radial contour of blade 26, 28, 30, 32, 34; 58 and the contour of the associated flow element 60 is in the range between 65° and 95°. Preferably, on the inflow side of the relevant blade 26, 28, 30, 32, 34; 58 a maximum first angle $\alpha$ is provided between the radial contour of blade 26, 28, 30, 32, 34; 58 and the contour of the associated flow element 60; on the outflow side of the relevant blade 26, 28, 30, 32, 34, 58, a maximum second angle $\beta$ is provided between the radial contour of blade 26, 28, 30, 32, 34, 58 and the contour of the associated flow element 60, and the maximum first angle $\alpha$ (alpha) is larger than the maximum second angle $\beta$ (beta).

Preferably the blades have, on the associated trailing edge, a row of teeth in the manner of a saw.

Preferably the first region extends, both on discharge side 45 and on suction side 44 of blade 26, 28, 30, 32, 34; 58, toward suction side 44; and the second region extends, both on discharge side 45 and on suction side 44 of blade 26, 28, 30, 32, 34; 58, toward discharge side 45.

The invention claimed is:

1. A fan adapted to produce, during operation, a predominantly non-radial airflow, having an impeller (20) which is equipped with a plurality of profiled blades (26, 28, 30, 32, 34; 58) and which, during operation, rotates about a rotation axis; and having an annular fan housing (42) radially surrounding the impeller (20) at a distance (69), each of the blades (26, 28, 30, 32, 34;58) having respective shapes selected such that, during operation, blade loadings of the respective blades differ from each other;

wherein the blades (58; 26, 28, 30, 32, 34) are respectively equipped, at their respective ends facing toward the surrounding fan housing (42), with an air guidance element (60), a tip gap (69) being defined between the air guidance element (60) and the fan housing (42);

wherein the air guidance elements (60) are each configured with a longitudinal twist with respect to a relevant blade wherein each air guidance element (60) is twisted toward a suction side (44) of the fan on an inflow side of the relevant blade, and toward the discharge side (45) of the fan on an outflow side of the relevant blade, to form the longitudinal twist.

2. The fan according to claim 1, wherein a graph of values said respective blade loadings, plotted sequentially about a circumference of said impeller, matches a sinusoidal value distribution.

3. The fan according to claim 2, wherein an angular difference $\Delta\varphi$ between a largest and a smallest circumferential dimension of two blades is at least 0.0010*D, where D=diameter of the impeller, measured in mm;

$\Delta\varphi$=angular difference between the largest and the smallest circumferential dimension of two blades, measured in degrees.

4. The fan according to claim 1, wherein an angular difference $\Delta\varphi$ between a largest and a smallest circumferential dimension of two blades blades is at least 0.0010*D, where D=diameter of the impeller, measured in mm;

$\Delta\varphi$=angular difference between the largest and the smallest circumferential dimension of two blades, measured in degrees.

5. The fan according to claim 1, wherein a difference between a longest and a shortest chord length (27, 29, 35) of the blades, measured in each case at their respective outer edges, is at least 0.0010*D, where D=diameter of the impeller, measured in mm, and chord length is measured in mm.

6. The fan according to claim 1, in which that region of the air guidance element (60) which is twisted toward the discharge side (45) is implemented with elasticity, in order to enable, during operation, an elastic deformation of that region toward the fan housing (42) and to reduce flow around the air guidance element (60) through the tip gap (69).

7. The fan according to claim 1, in which each of the air guidance elements (60) are configured such that a continuous pressure buildup from the inflow side toward the outflow side of the relevant blade (26, 28, 30, 32, 34; 58) occurs in the tip gap (69) between the air guidance element (60) and the surrounding fan housing (42).

8. The fan according to claim 1, in which all of said blades (58; 26, 28, 30, 32, 34) have a same entrance angle $\delta$ their respective leading edges (68).

9. A fan adapted to produce, during operation, a predominantly non-radial airflow, having an impeller (20) which is equipped with a plurality of profiled blades (26, 28, 30, 32, 34; 58) and which has associated with it a rotation axis (11) around which said impeller rotates during operation, in order to deliver air, from a suction or inflow side (44) to a discharge or outflow side (45); and having a fan housing (42) radially surrounding the impeller (20) at a distance (69);

air guidance elements (60) being provided at Ups of the blades (26, 28, 30, 32, 34; 58) and each being configured with a longitudinal twist with respect to a relevant blade, which elements each comprise, on an inflow side of the relevant blade (26, 28, 30, 32, 34; 58), a first region extending toward the suction side (44) of the fan, and, on an outflow side of the relevant blade, a second region extending toward the discharge side (45)

of the fan, as well as a transition region between the first region and second region, which regions are respectively separated from the radially surrounding fan housing (42) by a tip gap (69), such that each air guidance element (60) is twisted toward the suction side (44) of the fan on the inflow side of the relevant blade and twisted toward the discharge side (45) of the fan on the outflow side of the relevant blade to form the longitudinal twist in the air guidance element (60).

10. The fan according to claim 9, in which each air guidance element (60) is implemented as an edge strip on a radially outer edge of the respective blade (26, 28, 30, 32, 34; 58).

11. The fan according to claim 9, wherein the air guidance elements (60) each have a curvature that is different at one longitudinal end of the air guidance element from the curvature at the other longitudinal end of the air guidance element.

12. The fan according to claim 11, in which each of the air guidance elements is implemented elastically on an outflow side of the relevant blade (26, 28, 30, 32, 34; 58), wherein the relevant blade (26, 28, 30, 32, 34; 58) deforms so that it reduces flow of air around the relevant blade (26, 28, 30, 32, 34; 58) through the tip gap (69).

13. The fan according to claim 9 wherein, on the inflow side of the relevant blade (26, 28, 30, 32, 34; 58), an angle $\alpha$ between a radial contour of the blade (26, 28, 30,32, 34; 58) and a contour of an associated air guidance element (60) is in the range between 105° and 130°.

14. The fan according to claim 9, wherein, on the outflow side of the relevant blade (26, 28, 30,32, 34; 58) an angle $\beta$ between a radial contour of the relevant blade (26, 28,30, 32, 34; 58) and a contour of an associated air guidance element (60) is in the range between 65° and 95°.

15. The fan according to claim 9, wherein on the inflow side of the relevant blade (26, 28, 30, 32, 34; 58) a maximum first angle $\alpha$ is provided between a radial contour of the blade (26, 28, 30, 32, 34; 58) and a contour of an associated air guidance element (60); and wherein, on the outflow side of the relevant blade (26, 28,30, 32, 34; 58) a maximum second angle $\beta$ is provided between the radial contour of the blade (26, 28, 30, 32, 34; 58) and the contour of the associated air guidance element (60); and in which the maximum first angle $\alpha$ is larger than the maximum second angle $\beta$.

16. The fan according to claim 9, wherein the blades have, on each trailing edge of the blade, a serration.

* * * * *